United States Patent [19]

Pierce

[11] 4,006,353

[45] Feb. 1, 1977

[54] SIGNAL MULTIPLIER DEVICES

[75] Inventor: John N. Pierce, Lexington, Mass.

[73] Assignee: Signatron, Inc., Lexington, Mass.

[22] Filed: Nov. 21, 1975

[21] Appl. No.: 634,051

[52] U.S. Cl. ..... 235/194; 328/160

[51] Int. Cl.[2] ..... G06G 7/16

[58] Field of Search ..... 328/158, 159, 160; 331/38, 77; 235/194

[56] References Cited

UNITED STATES PATENTS

| | | | |
|---|---|---|---|
| 2,781,450 | 2/1957 | Ianouchewsky | 331/38 |
| 2,920,284 | 1/1960 | Beagles et al. | 331/38 |
| 3,223,928 | 12/1965 | Fayman | 331/38 X |
| 3,321,614 | 5/1967 | Levadi | 235/194 |
| 3,493,737 | 2/1970 | Edelson | 235/194 X |
| 3,810,067 | 5/1974 | Heidecker | 328/158 X |
| 3,914,591 | 10/1975 | Logan | 235/194 |

*Primary Examiner*—John S. Heyman
*Attorney, Agent, or Firm*—Robert F. O'Connell

[57] ABSTRACT

A signal multiplier for multiplying first and second input signals each having time-varying amplitudes and relatively wide bandwidths in which a first input signal is added to at least one sinusoidal reference signal having an amplitude larger than that of the first input signal. The amplitude of the signal so produced is limited and the limited amplitude signal is multiplied by the second input signal to produce an unfiltered signal. The signal components thereof having undesired frequency spectra are then filtered to produce a signal proportional to the product of the first and second input signals.

25 Claims, 7 Drawing Figures

SIGNAL MULTIPLIER DEVICES

INTRODUCTION

This invention relates generally to multiplier devices for multiplying two electrical signals to yield a product thereof and, more particularly, to the multiplication of two broadband signals having signal components at relatively high frequencies.

BACKGROUND OF THE INVENTION

In communications receivers, analog processing equipment, and the like, it is often necessary to perform a multiplication of two signals $x(t)$ and $y(t)$ to yield an output signal wave form which represents the product thereof. When the wave forms of $x(t)$ and $y(t)$ are relatively slowly varying, the power spectra thereof have no significant components at relatively high frequencies. In such cases, conventional multiplier circuits are available which can provide the desired product wave forms without difficulty. However, a problem arises when both $x(t)$ and $y(t)$ vary in such a manner that the power spectra thereof have components that are of relatively high frequencies, e.g., frequencies of greater than 100 kHz, for example. Present techniques for dealing with such high frequency component problems have proved unsatisfactory in producing accurately the desired wave form.

One approach which has been utilized for such purpose is applicable when either $x(t)$ or $y(t)$ has special amplitude characteristics. Specifically, for example, if $x(t)$ is such that it assumes only two amplitude states, $\pm V$ as defined by the expression $$x(t) = \begin{Bmatrix} +V \\ -V \end{Bmatrix},$$

a bridge multiplier circuit using diode gates has been utilized and permits almost arbitrarily large bandwidths for both $x(t)$ and $y(t)$ to be present in producing the product wave form. Such an approach would also be useful even if $x(t)$ is, for example, of the form:

$$x(t) = V \cos[\omega t + \phi(t)],$$

where V is a constant amplitude and all of the variations of $x(t)$ from a pure sinusoid are conveyed by the phase modulation term $\phi(t)$. A gated-diode bridge multiplier circuit can be used with such a wave form because the gates open and close coincidentally with the zero-crossings of $x(t)$ which zero-crossings essentially carry all of the necessary information concerning the phase mudulation term $\phi(t)$. Although such bridge circuitry permits relatively wide bandwidths for the $x(t)$ and $y(t)$ input signals, it is limited to multiplying signals at least one of which has a constant amplitude.

Another approach which has been suggested also involves a bridge circuit using PIN-diodes. The PIN-diode bridge circuit permits the amplitudes of both $x(t)$ and $y(t)$ to vary. However, because of transit-time limitations thereof, one of the inputs to the multiplier circuitry must have its spectral content (i.e., its frequency components) limited to frequencies below about 100 kHz. Such a limitation on the use thereof prevents such a bridge circuit from being applicable in many analog processing systems wherein the frequency components are significantly larger than 100 kHz.

SUMMARY OF THE INVENTION

In accordance with the invention, the multiplication of two wave forms, the amplitudes of both of which can vary and both of which have frequency components significantly larger than 100 kHz, is provided. In accordance with one embodiment of the invention, one of the signal wave forms $x(t)$, for example, is combined with a pair of sinusoidally varying signals, as by adding thereto, to produce two new wave forms which contain all of the information that is present in $x(t)$ but which new wave forms each have a constant amplitude and are phase modulated by the information in $x(t)$. Such wave forms because of their constant amplitudes are each then combined, as by multiplying therewith, the other of the input signal wave forms, $y(t)$, using, for example, the conventional wide band, gated-diode bridge multipliers discussed above. The desired product of the two input signal wave forms can then be appropriately reconstructed from the component products which have been so generated.

The invention can be described in more detail with the help of the accompanying drawings wherein FIG. 1 shows a block diagram of one embodiment of the invention;

Figure 1:
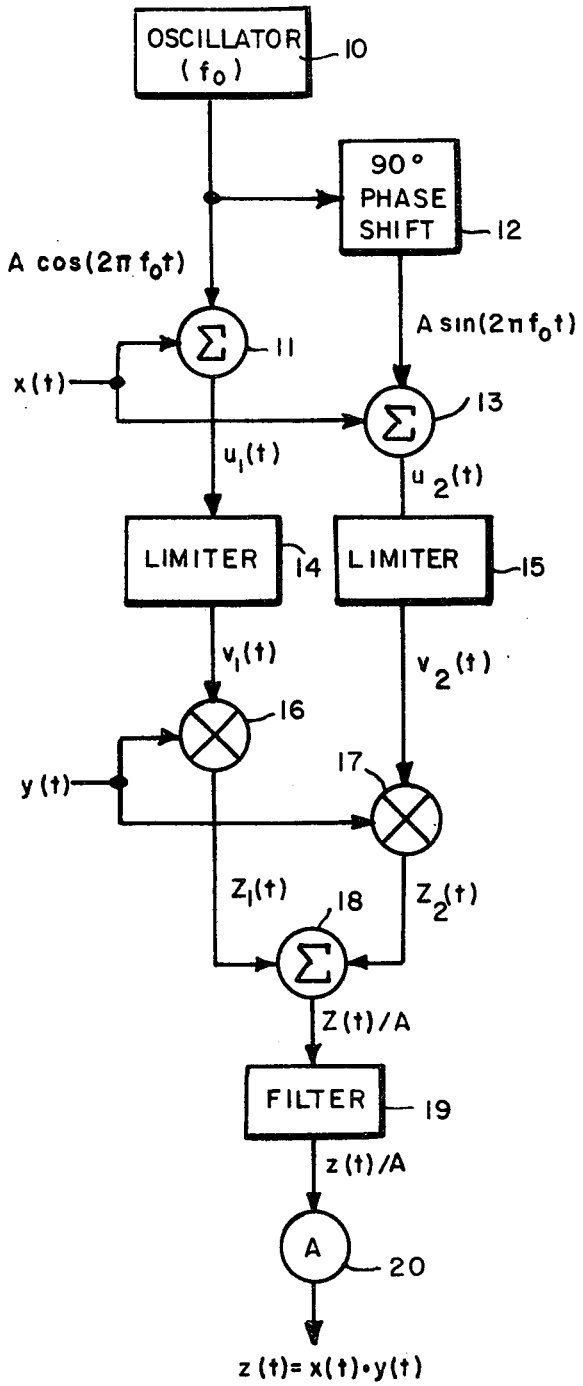

FIG. 1 shows one embodiment of the invention in block diagram form. As can be seen therein, a conventional oscillator circuit 10 produces a sinusoidally varying signal having a frequency $f_0$ and a constant amplitude A. The amplitude A of the output signal from oscillator 10 is such that it is much greater than the maximum expected amplitude of the input signal with which it is combined as described later. In the embodiment of FIG. 1, the output from oscillator 10 is provided at the input of a summing circuit 11 and is further shifted in phase by 90° at phase shifter 12, the output of which is then supplied as an input to a second summing circuit 13. The inputs from oscillator 10 to summing circuits 11 and 13 are identified as A cos $(2\pi f_0 t)$ and A sin $(2\pi f_0 t)$, respectively. The 90° phase shift is easily obtained by conventional methods and operates to shift the phase only at the oscillator frequency $f_0$. For example, in many applications, the phase shift may merely be a coaxial cable which is one-quarter wave length long at the frequency $f_0$ of interest. Further, the oscillator circuitry may be any standard sinusoid oscillator, the stability requirements of which are relatively minimal. The summing devices 11 and 13 are ordinary hybrid summing circuits well known to those in the art. The sinusoidal signals from oscillator 10 are combined thereby with one of the input signals which is to be one of the factors of the output product. For example, the signal $x(t)$ may be supplied to each of the summing circuits 11 and 13. The output of the summing circuits are designated as intermediate signals $u_1(t)$ and $u_2(t)$ as shown, and represent the summations of the input signal $x(t)$ with the constant amplitude sinusoidally varying signals from oscillator 10.

The intermediate signals $u_1(t)$ and $u_2(t)$ are then each supplied to the inputs of limiter circuits 14 and 15, respectively, which remove any amplitude variations of the signal $u_1(t)$ and $u_2(t)$. The limiter output signals are identified by the designations $v_1(t)$ and $v_2(t)$, respectively. The latter signals are of constant amplitude and sinusoidal in form and are then supplied to one input of conventional wide band gated-diode bridge multipliers 16 and 17 which, as discussed above, require a constant amplitude for at least one input signal. The other inputs to multipliers 16 and 17 are each supplied with the second input signal $y(t)$. Multiplication of $v_1(t)$ and $v_2(t)$ by $y(t)$ yields the product signal components $Z_1(t)$ and $Z_2(t)$ at the outputs of multipliers 16 and 17 which components are then combined in summing circuitry 18 to produce a summation thereof identified as $Z(t)/A$. The latter signal is then filtered by filter 19 to remove any signal products from multipliers 16 and 17 which are outside the band or bands of frequency components expected to be obtained from a product of the input signals $x(t)$ and $y(t)$. The filter 19 may be, for example, a pass band filter the output signal of which is $z(t)/A$. Multiplication of the latter signal at coefficient multiplier 20 by a constant equal to the constant amplitude A of the signal from oscillator 10 then yields the signal $z(t)$ which is desired product signal $x(t)\cdot y(t)$.

The limiter circuitry 15 and 16, for example, can be readily implemented through the use of saturating amplifiers or by amplifiers followed by diode clipping devices in accordance with conventional limiter design practice. The multipliers 16 and 17 can be conventional wide band, high frequency mixers with the $v_1(t)$ and $v_2(t)$ signals presented to the local oscillator ports thereof, the $y(t)$ signal being presented to the signal (or R.F.) ports thereof, and the $z_1(t)$ and $z_2(t)$ signals being obtained at the output (or I.F.) ports thereof. The filter 19 can be a simple bandpass filter designed to pass only the desired frequency components of $x(t)$ and $y(t)$ product signal and may include rejection trap circuits for eliminating the undesired frequency terms and any other spurious frequency component signals which may arise at the outputs of the mixers.

Figure 2:
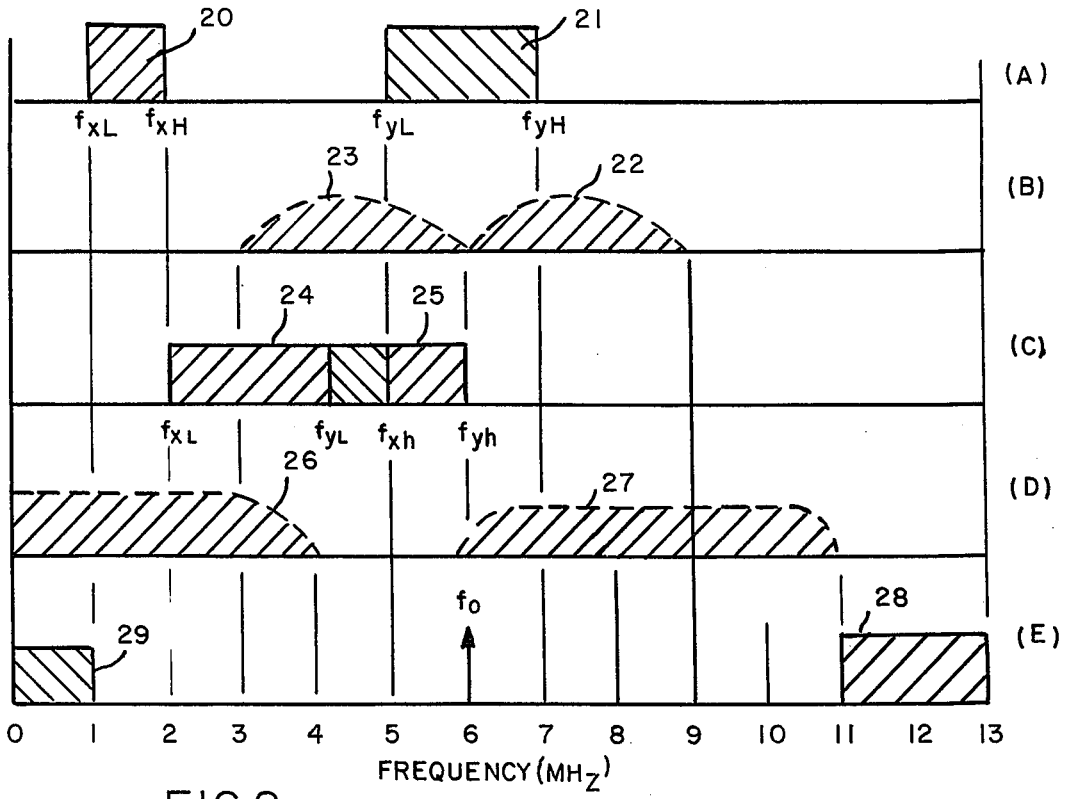
FIG. 2 shows a plurality of wave forms (A) through (E) for explaining the operation of the embodiment of FIG. 1.

In determining the selection of the local oscillator frequency $f_0$ at oscillator 10, FIGS. 2(A) – 2(E) are helpful in understanding such selection process. Thus, FIG. 2(A) shows the exemplary frequency spectra 20 and 21 of the input signal $x(t)$ which includes frequencies from the lowest frequency $f_{xL}$ to the highest frequency therein $f_{xH}$ and of the signal $y(t)$ shown as $f_{yL}$ to $f_{yH}$. The spectrum of the product term $x(t)\cdot y(t)$ contains signals the frequencies of which include the sums and differences of all the frequencies from $f_{xL}$ to $f_{yH}$ as shown by the spectra 22 and 23, respectively. Thus, if the spectra of $x(t)$ and $y(t)$ do not overlap, that is, the lowest frequency $f_{yL}$ of $y(t)$ is greater than the highest frequency $f_{xH}$ of $x(t)$, or vice versa, the product spectrum of the sum frequencies extends from $(f_{xL}+f_{yL})$ to $(f_{xH}+f_{yH})$ and the product spectrum of the difference frequencies extends from the smaller of $[|f_{yL}-f_{xH}|, |f_{xL}-f_{yH}|]$ to the larger of $[|f_{yH}-f_{xL}|, |f_{xH}-f_{yL}|]$, where the vertical bars designate the magnitudes of the frequency differences involved.

Thus, as seen in FIG. 2(B) when $f_{yL}$ is greater than $f_{xH}$, the sum frequency spectrum 22 extends from $(f_{xL}+f_{yL})$ to $(f_{xH}+f_{yH})$ and the difference frequency spectrum extends from $(f_{yL}-f_{xH})$ to $(f_{yH}-f_{xL})$.

If the spectra 24 and 25 of $x(t)$ and $y(t)$ overlap as in FIG. 2(C), the product spectrum 26 of the difference frequencies extends from 0 frequency to a maximum of $[|f_{yH}-f_{xL}|, |f_{xH}-f_{yL}|]$, while the product spectrum 27 of the sum frequencies, as before, extends from $(f_{xL}+f_{yL})$ to $(f_{xH}+f_{yH})$.

Further, the product of $(\cos 2\pi f_0 t)$ or $(\sin 2\pi f_0 t)$ with $y(t)$ has a spectrum containing sum frequencies and difference frequencies. The specific limits of the spectra thereof depend on whether the local oscillator frequency $f_0$ is selected between the lower and higher frequency limits of $y(t)$ or is outside such frequency limits.

In the system disclosed in FIG. 1, the oscillator frequency $f_0$ must be selected so that the product spectra $x(t)\cdot y(t)$ and the product spectra of $y(t)\cos(2\pi f_0 t)$ should not overlap. For example, as shown in FIG. 2(A), if the spectrum of $x(t)$ lies from 1 MHz to 2 MHz and the spectrum of $y(t)$ is from 5MHz to 7 MHz, the product spectra of the sum frequencies and the difference frequencies resulting therefrom lie in the overall spectrum 3 MHz to 9 MHz as shown in FIG. 2(B). In such a case, if $f_0$ is selected to be less than 4 MHz and greater than 0 MHz the difference frequency spectrum of the product of $y(t)\cdot\cos(2\pi f_0 t)$ will be larger than 3 MHz and will overlap the product sum and difference frequencies of $x(t)$ and $y(t)$. If further, $f_0$ is between 8 MHz and 16 MHz, then the difference frequencies between $f_0$ and either the high or low end frequencies $f_{xH}$ or $f_{xL}$ within the spectrum of $y(t)$ will fall between 3 and 9 MHz and will also overlap the product spectrum of $x(t)\cdot y(t)$. Accordingly, $f_0$ must be selected to lie between 4 MHz and 8 MHz or it can be selected to have any value greater than 16 MHz. An illustrative value of $f_0$ is selected at 6 MH in FIG. 2(E) which shows that the sum and difference spectra 28 and 29 of the product of $y(t)$ and $\cos(2\pi f_0 t)$ lie well outside the product spectra 22 and 23 of $x(t)\cdot y(t)$. Accordingly, the filters 19 shown in FIG. 1 can be utilized to filter out the $y(t)\cdot\cos(2\pi f_0 f)$ sum and difference frequencies in the spectra 28 and 29 so that the output of the filter 19 merely includes only the desired frequency components present in the product spectrum of $x(t)\cdot y(t)$.

Figure 3:
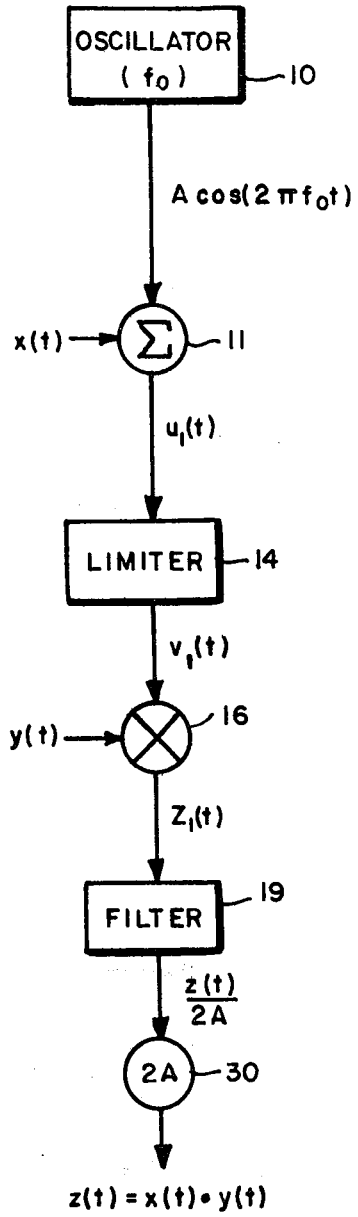
FIG. 3 shows a block diagram of another embodiment of the invention.

An approximation to the operation of the embodiment shown in FIG. 1 can be provided with a simplified modification thereof as shown in the embodiment of FIG. 3. The implementation of the invention shown in FIG. 3 permits the use of fewer components than those in FIG. 1, although a more severe restriction is placed on the selection of the oscillator frequency $f_0$, as explained below in more detail. Thus, as seen in FIG. 3, the phase shifted signal channel components are effectively omitted and the local oscillator 10 supplies the signal A $\cos(2\pi f_0 t)$ which is added to the first input signal $x(t)$ at one input of summation circuit 11. The output $u_1(t)$ thereof is supplied to limiter circuit 14 to provide a signal $v_1(t)$ which is then multiplied by $y(t)$ by wide band mixer 16 to produce $Z_1(t)$ which is then supplied to a filter 19 to produce a signal which is identified as $z(t)/2A$. Accordingly, multiplication by a constant factor 2A at coefficient multiplier 30 provides the desired product frequency signal $x(t)\cdot y(t)$. In the single channel system depicted in FIG. 3, in addition to the sum and difference frequencies discussed in FIG. 2, there is also an image frequency spectrum of $x(t)$ present at a frequency range symmetrically located with respect to the local oscillator frequency $f_0$. The product of the image frequency spectrum of $x(t)$ with $y(t)$ will contain sum frequencies well outside the spectrum band of the product spectra of $x(t)\cdot y(t)$, but it will also contain difference frequencies which may overlap the desired product spectra. For this reason, it is found that the allowable choice of the frequency $f_0$ is thereupon more limited when using the system of FIG. 3 than when using the system of FIG. 1. For example, the output of the limiter 14 contains the frequency $f_0$, the frequencies of the spectrum of $x(t)$, and the frequencies of the spectrum of the image of $x(t)$. The product of the image spectrum frequencies with $y(t)$ will contain sum frequencies which are far outside the $x(t)\cdot y(t)$ product spectra but may also contain difference frequencies which overlap the desired product if $f_0$ is not properly selected, as discussed with reference to FIG. 4.

Figure 4:
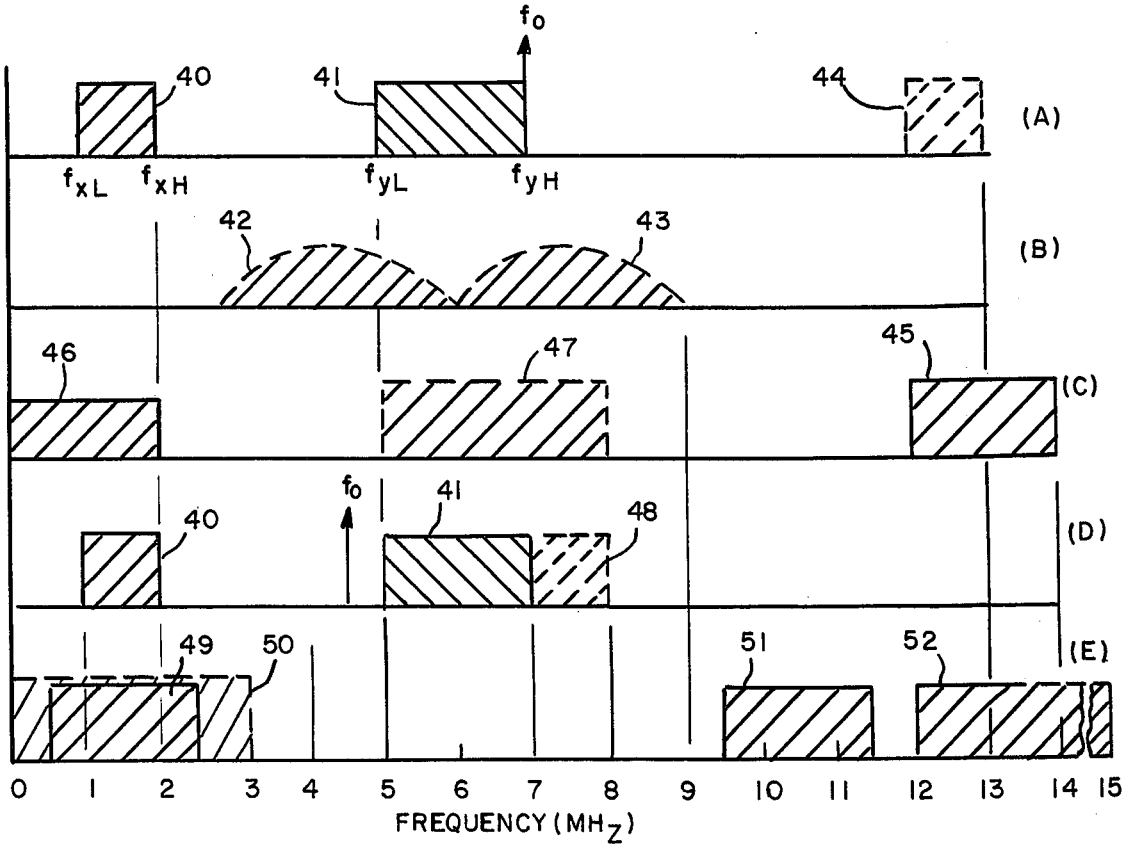
FIG. 4 shows a plurality of wave forms (A) through (E) for explaining the operation of the embodiment of FIG. 3.

Thus, as an example, if the spectrum 40 of $x(t)$ is from 1 MHz to 2MHz and the spectrum 41 of $y(t)$ is from 5 MHz to 7 MHz as shown in FIG. 4 (A) the product spectra 42 and 43, as shown in FIG. 4(B), lies from 3 MHz to 9 MHz, as discussed above with reference to FIGS. 2(A) and 2(B). However, in the system of FIG. 3, if $f_0$ is selected as 7 MHz, an image spectrum 44 of $x(t)$ is also present from 12 MHz to 13 MHz, as shown in FIG. 4(A). Thus the output of the mixer 16 includes the sum and difference frequency signals from the product $y(t)\cdot\cos(2\pi f_0 t)$ as shown by spectra 45 and 46, respectively, of FIG. 4(C). Such output also includes the sum and difference frequency spectra from the product of the image spectrum of $x(t)$ and $y(t)$. The sum frequency spectrum lies from 17 MHz to 20 MHz (not shown in FIG. 4(C)) and the difference frequency spectrum 47 lies from 5 MHz to 8 MHz, which latter spectrum overlaps the product spectrum of the product $x(t)\cdot y(t)$ shown in FIG. 4(B), so that the selection of $f_0$=7 MHz cannot be tolerated. It is found that in such a case a selection of $f_0$ only from 4.0 MHz to 4.5 MHz and above 16 MHz can be used. The use of $f_0$=4.5 MHz provides an $x(t)$ image spectrum from 7 MHz to 8 MHz, as shown in FIG. 4 (D), and spectra 49, 50, 51 and 52, as shown in FIG. 4(E), none of which overlap the desired product spectra 42 and 43 so that appropriate filtering can be used to remove the undesired spectra 49–52.

Thus, although the use of the dual channel system of FIG. 1 requires more components, it also permits a wider latitude in the choice of $f_0$ and has a simpler filtering problem at filter 19 than the use of the single channel operation of FIG. 3.

Figure 5:
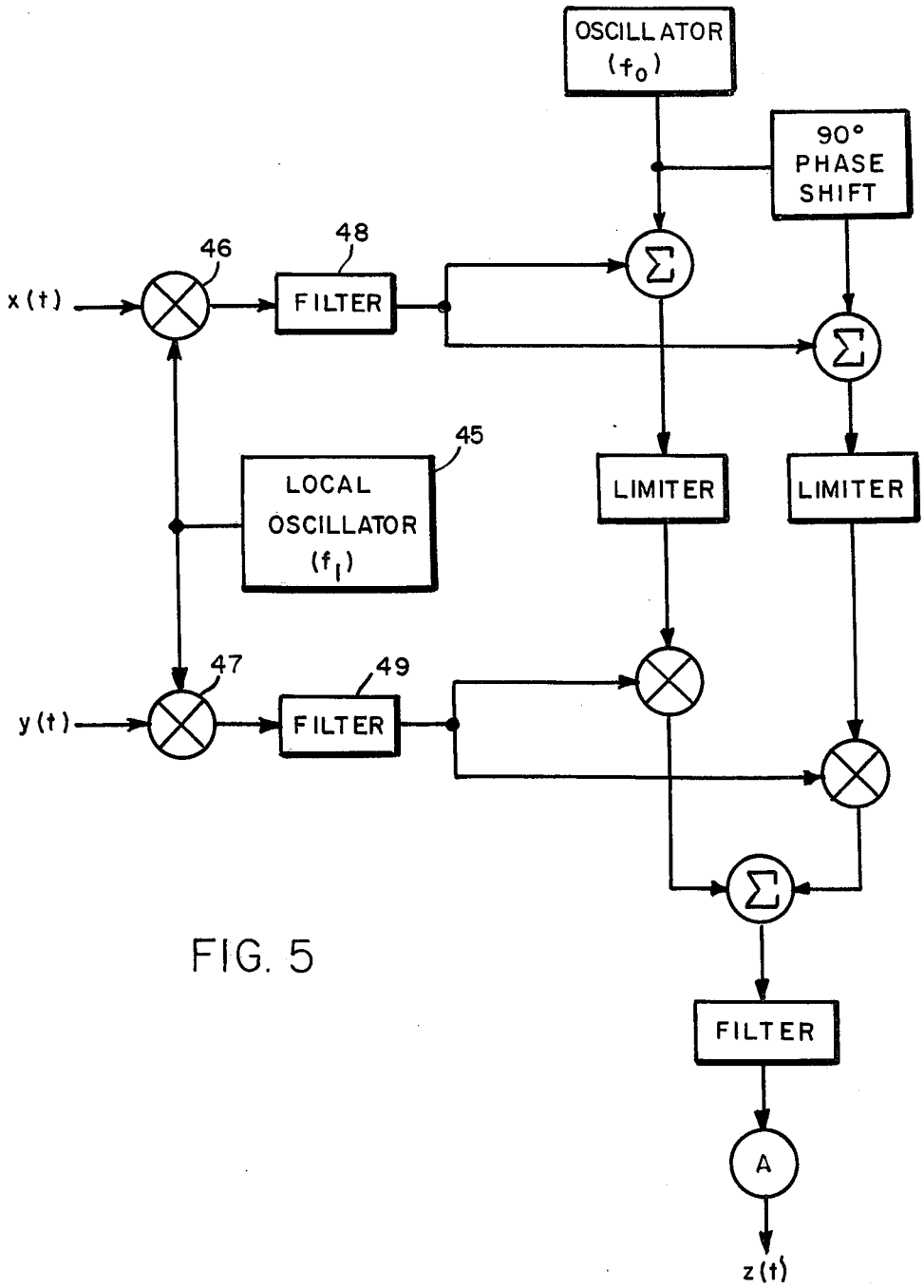
FIGS. 5, 6 and 7 show block diagrams of modifications of the embodiments of FIGS. 1 and 3.
Figure 6:
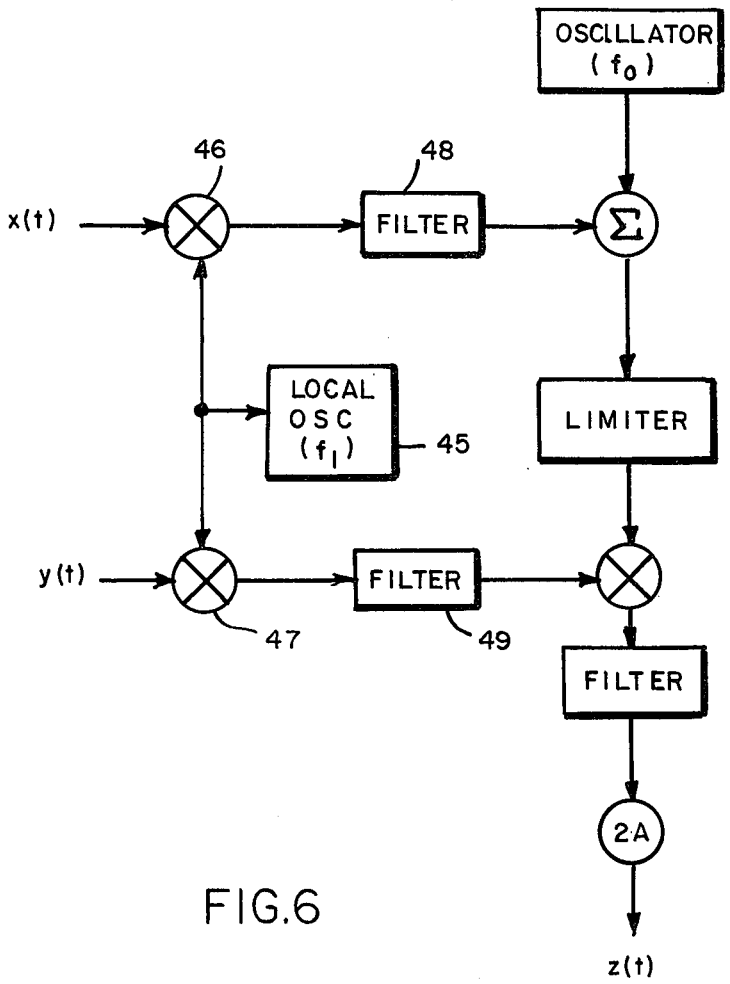

In the embodiments of FIGS. 1 and 3, if either $x(t)$ or $y(t)$ contains spectral components that overlap those of the $x(t)\cdot y(t)$ product spectra, the possibility exists of a feed-through of such spectral components if the mixers that form the products $y(t)\cdot v_1(t)$ and $y(t)\cdot v_2(t)$ are less than perfect in their operation. Such a possibility can be eliminated by the use of frequency translation techniques wherein either, or both, $x(t)$ and $y(t)$ are translated to a different frequency band prior to the overall multiplication process in FIGS. 1 and 3 so that the product thereof will lie in a different frequency band than its factors. The system of FIG. 5 shows such a modification of the system of FIG. 1 in this regard, while the system of FIG. 6 shows a similar modification of the system of FIG. 3. Thus, in FIGS. 5 and 6, for example, if both $x(t)$ and $y(t)$ contain frequency components which overlap those of the product signal, both $x(t)$ and $y(t)$ are multiplied by a signal from a local oscillator 45 having a frequency $f_1$ at mixers 46 and 47, respectively. The amplitude of the signal from local oscillator 45 is constant and such multiplication operation can easily be accomplished with readily available mixers or modulators known to the art. The spectra of the resulting products at mixers 46 and 47 effectively contain copies of the spectra of $x(t)$ and $y(t)$ symmetrically located about the frequency $f_1$. Filters 48 and 49, respectively, are placed at the outputs of mixers 46 and 47, respectively, to eliminate feed-through of $x(t)$ and $y(t)$, the image signals thereof and the oscillator frequency signal 8, and any undesired harmonics thereof. The outputs of the filter circuits 48 and 49 are then $x(t)\cdot\cos(2\pi f_1 t)$ and $y(t)\cdot\cos(2\pi f_1 t)$, respectively. The operation of the remainder of the circuits is exactly as discussed with reference to FIGS. 1 and 2. The output of the final summing device contains the desired product $z(t)$ and a copy of $z(t)$ translated in frequency by $2f_1$ which is easily removed by the final filter.

Figure 7:
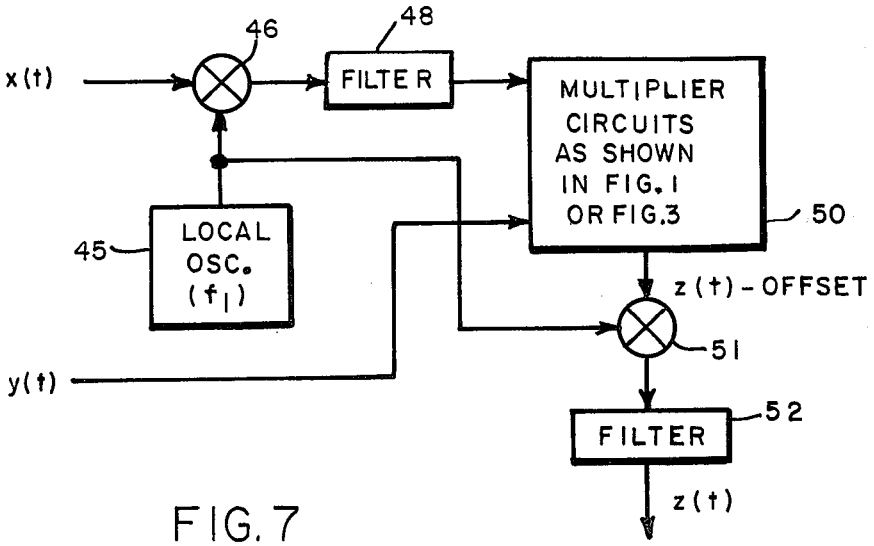

If only one of the signals to be multiplied contains frequency components which overlap those of the product signal, the frequency translation technique above can be used with only the overlapping signal. Thus, if the frequency components of $x(t)$ overlap those of $x(t)\cdot y(t)$, the frequency of the $x(t)$ signal can be translated, as shown in FIG. 7, while that of $y(t)$ is not so translated. In such case the multiplier output signal $z(t)$, which can be obtained from either of the multiplier circuits of FIG. 1 or FIG. 3, designated by block 50, is frequency offset by the same amount as $x(t)$, as designated by $z(t)$-offset. While in some applications such an offset multiplier output signal may be used as is, it is normally desirable to compensate for the offset by translating the frequency of $z(t)$ back to the desired spectrum in substantially the same manner via multiplier 51 and filter 52 as shown in FIG. 7. In a similar manner if the frequency components of $y(t)$ only overlap those of the product signal, only $y(t)$ need be frequency translated while $x(t)$ is retained in its original form. Appropriate compensation for the frequency offset $z(t)$ signal can also be provided.

In further modifications of the above embodiments of the invention, in many applications the mixing devices of 16 and 17 that perform the multiplication of $y(t)$ with $v_1(t)$ and with $v_2(t)$, respectively, can themselves function as limiters at sufficiently large driver levels at the local oscillator ports thereof. If such mixers are used, the limiters 14 and 15 may be omitted from all of the circuits shown in FIGS. 1, 3, 5 and 6.

What is claimed is:

1. A method for multiplying a first input signal and a second input signal, comprising the steps of generating at least one sinusoidal reference signal having a preselected frequency and a substantially constant amplitude greater than the maximum amplitude of said first input signal;

combining by addition said at least one reference signal and said first input signal to produce at least one intermediate signal;

limiting the amplitude of said at least one intermediate signal to a predetermined level and combining by multiplication said at least one limited amplitude signal and said second input signal to produce an unfiltered signal, and filtering said unfiltered signal to produce a filtered signal proportional to the product of said first imput signal and said second input signal.

2. A method for multiplying a first input signal and a second input signal comprising the steps of generating a first sinusoidal reference signal and a second sinusoidal reference signal each having the same preselected frequency and the same substantially constant amplitude, said amplitude being greater than the maximum amplitude of said first input signal and the phases of said first and second sinusoidal reference signals differing by 90°;

combining by addition said first input signal and each of said first and second reference signals to produce first and second intermediate signals;

limiting the amplitudes of said first and second intermediate signals to a predetermined level and combining by multiplication each of said first and second limited amplitude signals and said second input signal to produce first and second product signals;

adding said first and second product signals to produce an unfiltered signal; and filtering said unfiltered signal to produce a filtered signal proportional to the product of said first input signal and said second input signal.

3. A method for multiplying a first input signal and a second input signal, comprising the steps of generating a sinusoidal reference signal having a preselected frequency and a substantially constant amplitude greater than the maximum amplitude of said first input signal;

combining by addition said reference signal and said first input signal to produce an intermediate signal;

limiting the amplitude of said intermediate signal to a predetermined level and combining by multiplication said limited amplitude signal and said second input signal to produce an unfiltered signal; and filtering said unfiltered signal to produce a filtered signal proportional to the product of said first input signal and said second input signal.

4. A method in accordance with claim 2 wherein said preselected frequency is selected so that the frequency spectrum of the product of said second input signal and said first sinusoidal reference signal does not overlap the frequency spectrum of the product of said first and said second input signal.

5. A method in accordance with claim 3 wherein said preselected frequency is selected so that the frequency spectrum of the product of said second input signal and said sinusoidal reference signal and the frequency spectrum of the product of said second input signal and the image of said first input signal about said reference signal frequency do not overlap the frequency spectrum of the product of said first and said second input signals.

6. A method in accordance with claim 4 and further including the step of multiplying said filtered signal by a constant proportional to the constant amplitude of said reference signal to produce an output signal equal to the product of said first and said second input signals.

7. A method in accordance with claim 5 and further including the step of multiplying said filtered signal by a constant proportional to the constant amplitude of said reference signal to produce an output signal equal to the product of said first and said second input signals.

8. A method in accordance with claim 4 and further including the step of translating the frequency of at least one of said first and said second input signals to a preselected region of the frequency band which is remote from the region thereof in which the frequency spectrum of the product of said first and said second input signals lies before the corresponding combining step associated therewith.

9. A method in accordance with claim 8 and further including the steps of translating the frequency of only one of said first and said second input signals to said preselected region of the frequency band which is remote from the region thereof in which the frequency spectrum of the product of said first and said second input signals lies; and translating the frequency of the signal representing the product of said first and second input signals to the region of said frequency band containing the frequency spectrum of said only one of said first and said second input signals before the frequency translation thereof.

10. A method in accordance with claim 8 and further including the step of translating the frequencies of both said first and said second input signals to said preselected region of the frequency band which is remote from the region thereof in which the frequency spectrum of the product of said first and said second input signals lies before the corresponding combining step associated therewith.

11. A method in accordance with claim 5 and further including the step of translating the frequency of at least one of said first and said second input signals to a preselected region of the frequency band which is remote from the region thereof in which the frequency spectrum of the product of said first and said second input signals lies before the corresponding combining step associated therewith.

12. A method in accordance with claim 11 and further including the steps of translating the frequency of only one of said first and said second input signals to said preselected region of the frequency band which is remote from the region thereon in which the frequency spectrum of the product of said first and second input signals lies; and translating the frequency of the signal representing the product of said first and second input signals to the region of said frequency band containing the frequency spectrum of said only one of said first and said second input signals before the frequency translation thereof.

13. A system for multiplying a first input signal and a second input signal comprising means for generating at least one sinusoidal reference signal having a substantially constant amplitude larger than the maximum amplitude of said first input signal;

means for adding said at least one sinusoidal reference signal and said first input signal to produce at least one intermediate signal;

means responsive to said at least one intermediate signal and to said second input signal for limiting the amplitude of said intermediate signal and for multiplying said limited amplitude intermediate signal and said second input signal to produce at least one unfiltered signal; and means for filtering said at least one unfiltered signal to produce a filtered signal proportional to the product of said first and said second input signals.

14. A system for multiplying a first input signal and a second input signal comprising means for generating a first sinusoidal reference signal having a substantially constant amplitude larger than the amplitude of said first input signal;

means for shifting the phase of said sinusoidal reference signal by 90° to produce a second phase shifted sinusoidal reference signal;

means for adding said first input signal and said first and second reference signals to produce first and second intermediate signals;

means responsive to said first and second intermediate signals for limiting the amplitudes thereof and for combining by multiplication each of said first and second limited amplitude signals and said second input signal to produce first and second unfiltered signals;

means for adding said first and second unfiltered signals to produce an untiltered output signal; and filter means for filtering said unfiltered output signal to produce a filtered output signal proportional to the product of said first and said second input signals.

15. A system for multiplying a first input signal and a second input signal comprising means for generating a sinusoidal reference signal having a substantially constant amplitude larger than the maximum amplitude of said first input signal;

means for adding said reference signal and said first input signal to produce an intermediate signal;

means responsive to said intermediate signal and to said second input signal for limiting the amplitude of said intermediate signal and for multiplying said limited amplitude intermediate signal and said second input signal to produce an unfiltered signal;

means for filtering said unfiltered signal to produce a filtered signal proportional to the product of said said first and said second input signals.

16. A system in accordance with claim 13 and further including means for multiplying said filtered signal by a preselected proportionality constant to produce an output signal representing the product of said first and said second input signals.

17. A system in accordance with claim 14 and further including means for multiplying said filtered signal by a preselected proportionality constant to produce an output signal representing the product of said first and said second input signals.

18. A system in accordance with claim 14 and further including means for translating the frequency spectrum of at least one of said first and said second input signals to a preselected region of the frequency band which is remote from the region thereof in which the frequency spectrum of the product of said first and said second input signals lies.

19. A system in accordance with claim 18 wherein said frequency translating means includes means for generating a local oscillator signal;

at least one means for mixing said local oscillator signal and said at least one of said first and second input signals to produce at least one mixer output signal; and at least one means for filtering said at least one mixer output signal to produce at least one input signal having its frequency spectrum translated to said preselected region of the frequency band.

20. A system in accordance with claim 18 wherein said translating means translates the frequency spectrum of only one of said first and said second input signals to said preselected region of the frequency band and further including further means for translating the frequency of the signal representing the product of said first and second input signals to the region of said frequency band containing the frequency spectrum of said only one of said first and said second input signals before the frequency translation thereof.

21. A system in accordance with claim 18 wherein said translating means translates the frequency spectra of both said first and said second input signals to preselected regions of the frequency band which are remote from the region in which the frequency spectrum of the product of said first and said second input signals lies.

22. A system in accordance with claim 15 and further including means for translating the frequency spectrum of at least one of said first and said second input signals to a preselected region of the frequency band which is remote from the region thereof in which the frequency spectrum of the product of said first and said second input signals lies.

23. A system in accordance with claim 22 wherein said frequency translating means includes means for generating a local oscillator signal;

at least one means for mixing said local oscillator signal and said at least one of said first and second input signals to product at least one mixer output signal;

at least one means for filtering said at least one mixer output signal to produce at least one input signal having its frequency spectrum translated to said preselected region of the frequency band.

24. A system in accordance with claim 22 wherein said translating means translates the frequency spectrum of only one of said first and said second input signals to said preselected region of the frequency band and further including further means for translating the frequency of the signal representing the product of said first and second input signals to the region of said frequency band containing the frequency spectrum of said only one of said first and said second input signals before the frequency translation thereof.

25. A system in accordance with claim 22 wherein said translating means translates the frequency spectra of both said first and said second input signals to preselected regions of the frequency band which are remote from the region in which the frequency spectrum of the product of said first and said second input signals lies.

* * * * *